US008947177B2

(12) United States Patent
Kokkinos

(10) Patent No.: US 8,947,177 B2
(45) Date of Patent: Feb. 3, 2015

(54) COUPLING MECHANISM FOR A PCB MOUNTED MICROWAVE RE-ENTRANT RESONANT CAVITY

(75) Inventor: Titos Kokkinos, Dublin (IE)

(73) Assignee: Alcatel Lucent, Boulogne-Billancourt (FR)

( * ) Notice: Subject to any disclaimer, the term of this patent is extended or adjusted under 35 U.S.C. 154(b) by 28 days.

(21) Appl. No.: 13/702,372

(22) PCT Filed: Jun. 21, 2011

(86) PCT No.: PCT/EP2011/060266

§ 371 (c)(1),
(2), (4) Date: Feb. 4, 2013

(87) PCT Pub. No.: WO2012/000822

PCT Pub. Date: Jan. 5, 2012

(65) Prior Publication Data

US 2013/0130519 A1 May 23, 2013

(30) Foreign Application Priority Data

Jun. 29, 2010 (EP) ..... 10305699

(51) Int. Cl.
*H01P 1/202* (2006.01)
*H01P 7/04* (2006.01)
(Continued)

(52) U.S. Cl.
CPC ..... *H01R 12/71* (2013.01); *H01P 1/2053* (2013.01); *H01P 1/2088* (2013.01); *H01P 7/04* (2013.01)
USPC ..... 333/206; 333/222

(58) Field of Classification Search
CPC ..... H01P 1/208; H01P 1/205; H01P 1/2053; H01P 1/207; H01P 7/04; H01P 7/06
USPC ..... 333/206, 208, 212, 222, 227, 230
See application file for complete search history.

(56) References Cited

U.S. PATENT DOCUMENTS

2003/0076188 A1 4/2003 Dawn et al.
2005/0200424 A1 9/2005 Takeda et al.
(Continued)

FOREIGN PATENT DOCUMENTS

EP 1304762 A2 4/2003
WO WO-2008036178 A1 3/2008
(Continued)

OTHER PUBLICATIONS

International Search Report PCT/ISA/210, PCT/EP/2011/060266 Aug. 31, 2011.
(Continued)

*Primary Examiner* — Robert Pascal
*Assistant Examiner* — Gerald Stevens
(74) *Attorney, Agent, or Firm* — Harness, Dickev & Pierce

(57) ABSTRACT

The microwave signals are coupled from a transmission line embedded in a Printed Circuit Board PCB to a resonant cavity mounted on an external metalized surface of this PCB. The coupling mechanism implements an easy-to-fabricate mechanism leading to high-quality filtering owing to the fact that the end of the transmission line is provided with a metalized feeding pad located at the external layer of the PCB inside the resonant cavity. The resonant cavity is provided with a re-entrant inner stub orthogonal to the PCB and separated from the PCB by a capacitive gap. The metalized feeding pad is facing the inner stub in the area of the capacitive gap and is offset from the axial direction of this inner stub. The metalized feeding pad is further separated from the external metalized surface of the PCB by a surface capacitive gap.

9 Claims, 8 Drawing Sheets

(51) Int. Cl.

| | |
|---|---|
| ***H01R 12/71*** | (2011.01) |
| ***H01P 1/205*** | (2006.01) |
| ***H01P 1/208*** | (2006.01) |

(56) References Cited

U.S. PATENT DOCUMENTS

| | | | | |
|---|---|---|---|---|
| 2005/0217786 | A1* | 10/2005 | Geller et al. | 156/89.11 |
| 2005/0225411 | A1* | 10/2005 | Sauder et al. | 333/202 |
| 2008/0024249 | A1 | 1/2008 | Schreibvogel | |
| 2008/0068111 | A1 | 3/2008 | Hesselbarth | |
| 2008/0297283 | A1 | 12/2008 | Byun et al. | |

FOREIGN PATENT DOCUMENTS

| | | | |
|---|---|---|---|
| WO | WO-2008036179 | A1 | 3/2008 |
| WO | WO-2008036180 | A2 | 3/2008 |

OTHER PUBLICATIONS

Hesselbarth, J. "Surface-mount cavity filter technology", Proc. European Microwave Conference 2007, pp. 442-445, Oct. 2007.

* cited by examiner $$C_{ser} = k\, C_{gap}$$
$$C_o = (1-k)\, C_{gap}$$

COUPLING MECHANISM FOR A PCB MOUNTED MICROWAVE RE-ENTRANT RESONANT CAVITY

The present invention relates to a coupling mechanism to couple microwave signals from a transmission line embedded in a Printed Circuit Board PCB to a resonant cavity mounted on said PCB.

The RF front-end filtering/duplexing device constitutes one of the most critical devices for the performance and compliance of modern cellular, high-power, base-stations (BTS). Due to the requirement for high overall BTS power efficiency and the strict compliance rules imposed by the regulatory authorities, the transfer function of these filtering/duplexing devices should meet several stringent specifications such as minimal in-band insertion loss, maximal out-of-band rejection, and high close-to-band selectivity. The implementation of such transfer functions, together with the high-power handling capability that is usually required, result into filtering devices that are bulky in volume and expensive in their fabrication.

In terms of the underlying RF technology, these filters are usually composed of waveguide/cavity resonators, coupled through irises or other defects on the walls that form the cavities. Given that the exact dimensions of the resonating cavities and the employed coupling mechanisms determine the filters' RF characteristics (operation band, insertion loss, return loss) high mechanical accuracy is required during their fabrication. Nevertheless, the required accuracy is almost never achieved during the production process and, therefore, post-production manual tuning is required for the optimization of the filters' transfer function.

Future cellular networks, able to support much higher data rates and heavier traffic, are envisioned to be composed of smaller cells (smaller radiated power per BTS) or to employ BTS composed of several modular radios, radiating medium power levels per element (e.g. Active Antenna Arrays). In such cases, the reduced power radiated by each BTS RF front-end could allow for relaxed filter requirements (e.g. relaxed requirements for the in-band insertion losses or the close-to-band selectivity), but the architecture of these BTS would impose some extra requirements related with the filters' volume and weight, and their integrability with the remaining RF front-end.

Given these new requirements, the filtering/duplexing devices of future, small cell or modular BTS could resemble more those currently employed in mobile terminals than the traditional high-power filtering/duplexing devices of modern BTS. In reality, filtering technologies that position themselves between these two extreme cases (in terms of their quality performance and their size properties) would be the most suitable for such applications.

Ceramic filters are one of the technologies that could provide niche solutions for such applications. Nevertheless, the design of such filters meeting medium power-handling specifications (e.g. average power greater than 4 W) or strict isolation conditions (e.g. Tx/Rx isolation for the FDD LTE 2.6 GHz band) is not always possible. Besides, the cost of this technology is very much dependant on the production volume, and unless such filters are produced in multi-million quantities, the cost per filter remains relatively high.

Another filtering technology that could be employed in applications that require simultaneously high quality filtering performance and relatively small-size properties or integrability features is the surface-mount filtering technology. In this approach, 3-D resonant cavities (able to deliver high-Q values), such as re-entrant (coaxial) resonators, are mounted on conventional Printed Circuit Boards PCBs. These cavities are interconnected through transmission lines embedded in the PCB. The same transmission lines are also used for the implementation of the required filtering function. In that way, the filtering devices can be integrated with the remaining of the RF front-end on the same PCB.

A cross-sectional representation of a conventional microwave re-entrant (coaxial) resonator mounted on a Printed Circuit Board PCB 14 is depicted in FIG. 1. In this configuration, the 3-D part of a resonator 10 is soldered (through a soldering layer 13) on the external metalized surface of the Printed Circuit Board PCB 14. In this case, both the 3-D part of the resonator 10 and the external surface of the PCB that is bounded by the 3-D component are forming a resonant cavity 15. As far as the 3-D part of the resonator 10 is concerned, it is composed of an outer wall 11, an internal re-entrant stub/rod 12 and may be of either cylindrical or rectangular shape (in a coaxial configuration). This part can be formed by either milling in or casting from a metallic volume, or by metal-plating plastic 3-D forms (for weight reduction).

The electromagnetic properties of the resonant, air-filled cavity 15 are dependent on the exact dimensions of the effective coaxial configuration (i.e. the length of the inner rod 12 and its distance from the external wall 11 of the cavity) and the capacitive gap 16 formed between the inner rod 12 and the external metalized surface of the PCB that comprises part of the resonant cavity.

For the synthesis of microwave filtering structures using resonant cavities similar with that of FIG. 1, microwave signals have to be guided to and away from the cavity. This can be done through the employed PCB and by embedding on it different types of transmission lines. This is also schematically represented in FIG. 1, where an embedded on the PCB input waveguide/transmission line 17 guides the microwave signal to the cavity, feeds the signal into the cavity through a coupling mechanism 18 and then the resonating signal is fed through another coupling mechanism 19 to an output waveguide/transmission line 20.

Then, microwave filters can be synthesized based on conventional filter synthesis models such as that of FIG. 2, where the employed resonators 30 are interconnected through admittance inverters 31, properly synthesized to implement specific transfer functions. In the case of cavities such as that of FIG. 1, the inverters can be designed using also PCB-embedded transmission lines.

For the implementation of resonant cavities such as that of FIG. 1, the design of the coupling mechanisms 18, 19 in a way that the comparative advantages of this configuration remain untouched (fully printed interconnecting lines and coupling mechanisms) constitutes the most challenging part.

Solutions are proposed, e.g., in documents of Jan Hesselbarth such as the Patent Application WO 2008/036180 A2 entitled "Re-entrant resonant cavities, filters including such cavities and method of manufacture", the Patent Application WO 2008/036179 A1 entitled "Resonant cavities and method of manufacturing such cavities", the Patent Application WO 2008/036178 A1 entitled "Re-entrant resonant cavities, filters including such cavities and method of manufacture", and the publication "Surface-mount cavity filter technology", in Proc. European Microwave Conference 2007, pp. 442-445, October 2007.

Therein, the above challenge was tackled by splitting the 3-D resonant cavity in two halves and locating the first half of the cavity on the upper external surface of the PCB and other half of the cavity on the lower external surface of the PCB, as shown in FIG. 3. In this configuration, the two parts of the cavity were electrically connected through the PCB, using the via posts 44 embedded in the PCB, and the microwave signals were coupled electrically to and from the inner stub of the cavity through transmission lines 45 that were penetrating the cavity. This approach was experimentally validated, but, given that the PCB itself and the interconnecting via posts were part of the resonant cavities, the operation of the cavities in this configuration were usually accompanied with relatively high losses (decreased quality factors).

The major challenge in the design of coupling mechanisms for the feeding of microwave signals to and from PCB mounted 3-D resonant cavities is to retain the major comparative advantages of such configurations (high –Q resonators interconnected through fully-printed PCB-embedded networks), while achieving the desired functionality of low loss coupling mechanism providing a large range of coupling coefficients and some tunability for the cavity resonances.

An object of the present invention is to provide a coupling mechanism to feed microwave signals to a 3-D PCB mounted resonant cavity, similar with that of FIG. 1 described above, but which implements an easy-to-fabricate mechanism leading to high-quality filtering.

According to a characterizing embodiment of the invention, this object is achieved due to the fact that the end of said transmission line is provided with a metalized feeding pad located at the external layer of said PCB inside said resonant cavity.

In this way, the size and position of the metalized feeding pad defines and allows adjusting the coupling mechanism while providing high-quality filtering with reproducible characteristics.

Another characterizing embodiment of the present invention is that said resonant cavity is provided with a re-entrant inner stub orthogonal to said PCB and separated from said PCB by a capacitive gap, and that said metalized feeding pad is facing said inner stub in the area of said capacitive gap and is offset from the axial direction of said inner stub.

The proposed filter technology exhibits considerably improved performance as compared to the filter technology of the known prior art. The present technology is more robust to manufacturing errors and the operation of the resulting RF filters is associated with significantly reduced insertion losses (easier to maintain the high-Q values of the 3-D resonant cavities).

Also another characterizing embodiment of the present invention is that said resonant cavity is mounted on an external metalized surface of said PCB, and that said metalized feeding pad is separated from said external metalized surface by a surface capacitive gap.

The capacitive gap formed by relative position of the metalized feeding pad in offset with respect to the axial direction of the re-entrant inner stub and the surface capacitive gap separating the metalized feeding pad from the external metalized surface of the PCB define the characteristics of the coupling mechanism.

In a preferred characterizing embodiment of the present invention, said metalized feeding pad has the shape of a disk surrounded by said surface capacitive gap and whereof the centre is offset from the axial direction of said inner stub.

Although the metalized feeding pad may have most any shape, it has been proved that a disk form leads to optimal results.

In a variant embodiment of the present invention, said PCB is provided with an input embedded transmission line of which an input end is provided with an input metalized feeding pad, and with an output embedded transmission line of which an output end is provided with an output metalized feeding pad, and said input and output metalized feeding pads are located at the external layer of said PCB inside said resonant cavity and are separated by an electric wall.

The proposed filter technology provides a niche solution for applications (RF front-ends of modern BTS/nodeB/e-nodeB/etc) that require high-quality filtering performance and relatively high-power handling capabilities together with low-volume properties and a high degree of integration (filter integrated with the other components of the RF front-end). These features together with its low-cost and fully-automated fabrication process (fully-printed PCB/soldered top-mounted metalized-plastic cavities) make the present coupling mechanism a very promising technology for future PCB mounted microwave re-entrant resonant cavities.

Further characterizing embodiments of the present coupling mechanism are mentioned in the appended claims.

It is to be noticed that the terms "comprising" or "including", used in the claims, should not be interpreted as being restricted to the means listed thereafter. Thus, the scope of an expression such as "a device comprising means A and B" should not be limited to an embodiment of a device consisting only of the means A and B. It means that, with respect to embodiments of the present invention, A and B are essential means of the device.

Similarly, it is to be noticed that the term "coupled", also used in the claims, should not be interpreted as being restricted to direct connections only. Thus, the scope of the expression such as "a device A coupled to a device B" should not be limited to embodiments of a device wherein an output of device A is directly connected to an input of device B. It means that there may exist a path between an output of A and an input of B, which path may include other devices or means.

The above and other objects and features of the invention will become more apparent and the invention itself will be best understood by referring to the following description of an embodiment taken in conjunction with the accompanying drawings wherein.

Figure 4:
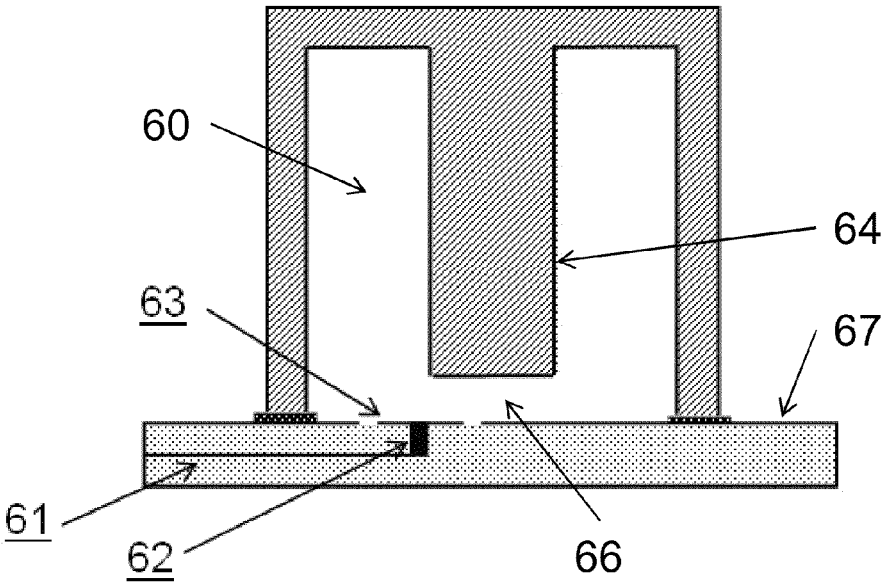
FIG. 4 shows a coupling mechanism employed to couple signals from a PCB-embedded waveguide (stripline) to a single PCB-mounted resonant cavity according to an embodiment of the invention.
Figure 5:
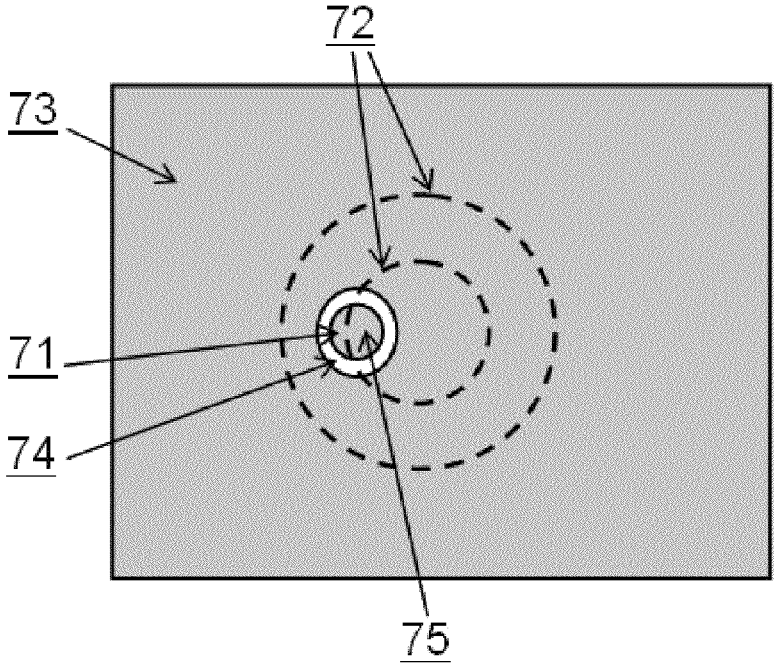
FIG. 5 is a top-view of the coupling mechanism of FIG. 4 at the level of the external surface of the PCB, with respect to the location of the mounted 3-D resonant cavity.

An embodiment of a coupling mechanism, that fulfills all the requirements of the present invention, is presented in FIG. 4 and FIG. 5.

A cross-sectional representation of a Printed Circuit Board PCB mounted microwave re-entrant resonant cavity is shown at FIG. 4, while FIG. 5 shows a top-view of the coupling mechanism at the level of the external surface of the PCB, with respect to the location of the mounted 3-D resonant cavity.

As in a conventional microwave re-entrant (coaxial) resonator mounted on a PCB, the 3-D part of the present resonator is soldered on an external metalized surface of the PCB. Both the 3-D part of the resonator and the external surface of the PCB that is bounded by the 3-D component are forming a resonant cavity 60. The 3-D part of the resonator is composed of an outer wall, an internal re-entrant stub or rod 64 and may be of either cylindrical or rectangular shape (in a coaxial configuration). This part can be formed by either milling in or casting from a metallic volume, or by metal-plating plastic 3-D forms, mainly for weight reduction.

The re-entrant inner rod 64 is orthogonal to the PCB with one end fixed to the outer wall and the other end facing the PCB and separated thereof by a capacitive gap 66.

The electromagnetic properties of the resonant, air-filled resonant cavity 60 are dependent on the exact dimensions of the effective coaxial configuration (i.e. the length of the inner rod 64 and its distance from the external wall of the cavity) and the capacitive gap 66 formed between the inner rod 64 and the external metalized surface of the PCB that comprises part of the resonant cavity.

The microwave signal is considered to be guided to the resonator through an embedded waveguide/transmission line 61 that employs the external metalized surface of the PCB, on which the 3-D cavity is mounted, as a ground plane. This line can be implemented, for example, in either microstrip or stripline technology. When the microwave signal reaches the end of the feeding transmission line, it is guided through a vertical via post (or an array of via posts) 62 to a metalized feeding pad 63 located, inside the cavity, at the external layer of the PCB on which the 3-D resonator is mounted.

In FIG. 5, the top view of this metalized feeding pad 71, with respect to the location of the coaxial configuration 72 of the resonant cavity mounted on the external surface of the PCB 73, is clearly depicted. Given that between the feeding pad 71 and the external surface 73 of the PCB there is no electrical connection, a displacement current will be supported across a surface capacitive gap 74 formed between them.

The metalized feeding pad 63/71 preferably has the shape of a disk which is surrounded by the surface capacitive gap 74 and whereof the centre is offset from the axial direction of the internal re-entrant stub/rod 64.

This is the first mechanism of electromagnetic coupling of the feeding microwave signal to the resonant cavity, given that the part of the external surface of the PCB around the metalized feeding pad comprises part of the resonant cavity, as was shown in FIG. 4.

The electromagnetic properties of this coupling (i.e. magnitude) are depended on the radius of the pad and the width of the surface capacitive gap 74. Both these features can be adjusted when designing the PCB, irrespectively of the 3-D part of the resonant cavity, and constitute significant design parameters while synthesizing a specific filtering transfer function and the corresponding PCB layout.

The second mechanism of electromagnetic coupling between the metalized feeding pad 63/71 and the resonant cavity is the capacitance supported between the inner stub 64 of the 3-D coaxial configuration and the feeding pad itself.

As shown in FIG. 5, the feeding pad and the inner stub of the resonator overlap over a surface 75 that is dependent on the radius of the feeding pad and its position (offset) with respect to the centre of the coaxial configuration of the 3-D part of the resonator. These two parameters constitute another two major design parameters that should be properly set during the filter synthesis and PCB layout design. The importance of this second coupling mechanism is attributed to the fact that apart from providing electromagnetic coupling between the feeding pad and the resonant cavity, it provides a means of slightly adjusting and tuning the resonance of the resonant cavity through the design/layout of the PCB.

Specifically, with the introduction of the feeding pad, the total capacitance supported between the external layer of the PCB on which the 3-D cavity is mounted and the inner stub of the coaxial configuration, that originally played a key role in the estimation of the total capacitance of the resonating cavity and its resonant frequency, is divided into two components. The first is the capacitance supported between the feeding pad and the inner stub of the 3-D part of the cavity and the second is the surface capacitance supported by the external PCB surface around the feeding pad overlaying with the inner stub of the 3-D part of the cavity. The ratio between these two capacitances should be equal with the ratio of the feeding pad surface and the external PCB surface overlaying with inner rod of the coaxial configuration and, hence, can be adjusted by adjusting the position of the feeding pad. Although the sum of these two capacitances should be approximately equal with the total capacitance of the first case, in the latter case the capacitance between the feeding pad and the inner stub of the coaxial configuration does not influence the capacitive characteristics and the resonant frequency of the resonant cavity.

Therefore, by altering (increasing/decreasing) this capacitance, the total capacitance of the resonant cavity can be inversely altered (decreased/increased). By this means, the effective resonant frequency of the resonant cavity can be adjusted through the design of the layout of the external PCB surface.

Figure 6:
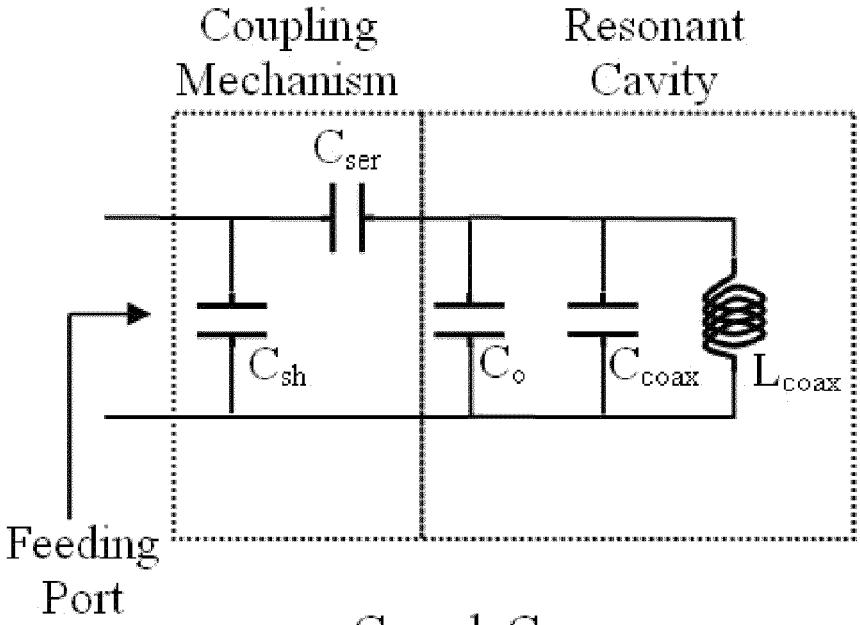
FIG. 6 represents an equivalent circuit of the coupling mechanism of FIGS. 4 and 5.

In order to schematically represent the major properties of the proposed coupling mechanism, the equivalent circuit of a configuration similar with that of FIG. 4 is shown in FIG. 6. In this equivalent circuit, the resonant cavity is represented through a shunt LC circuit that is composed of an inductance $L_{coax}$ and a capacitance $C_{coax}$ that are attributed to the 3-D coaxial configuration, and a capacitance $C_{gap}$ that is attributed to the capacitance supported between the inner stub of the coaxial configuration and the PCB surface on which the 3-D cavity is mounted and comprises part of the resonant cavity.

In the absence of the feeding pad, this capacitance is depended exclusively on the geometrical characteristics of the gap (gap width d and total area S over which the capacitance is supported $C_{gap}=\epsilon_o S/d$) and directly loads the coaxial resonator ($C_o=C_{gap}$ according to the notation of FIG. 6).

In the presence of the feeding pad, this capacitance is split in two components: one of them, that is supported between the inner stub of the resonator and the ground plane, loads the coaxial resonator similarly as before, and the second, that is supported between the inner stub of the resonator and the feeding pad, corresponds to a coupling capacitance that is serially connected to the resonator. The ratio between these two capacitances is defined by the fraction of the inner stub area overlapping with the feeding disk. Therefore, if the overlapping ratio is considered to be k, then Co=(1−k) $C_{gap}$ and $C_{ser}$=k $C_{gap}$. Finally, the coupling capacitance between the feeding disk and the external surface of the PCB that comprises part of the resonant cavity can be considered to be in parallel with the resonator ($C_{sh}$ in FIG. 6).

Figure 1:
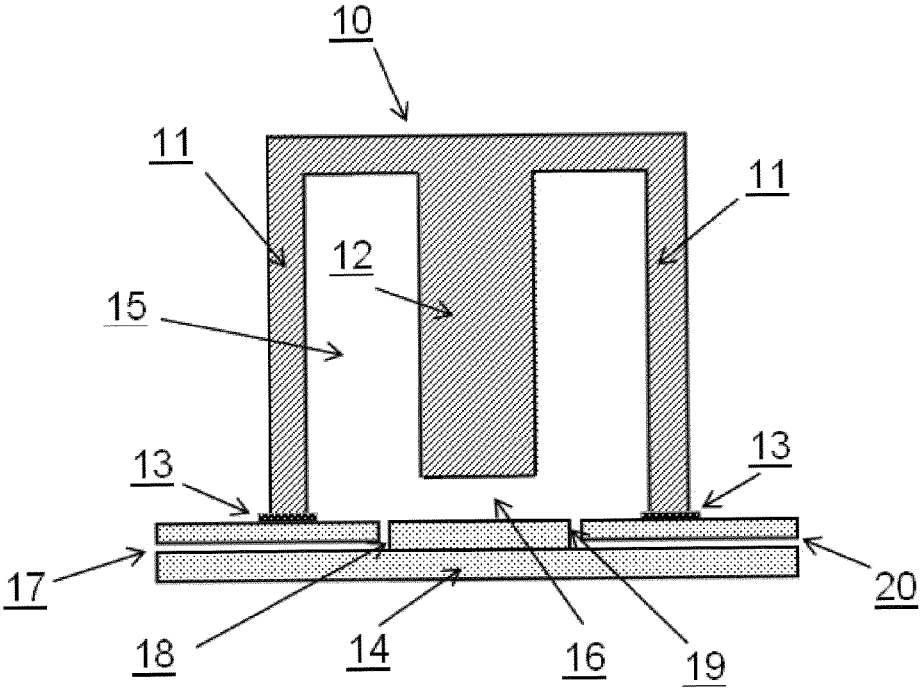
Fig. 1 Prior art
FIG. 1 shows a classical resonant cavity formed by a 3-D re-entrant (coaxial) resonator mounted on a PCB.
Figure 2:
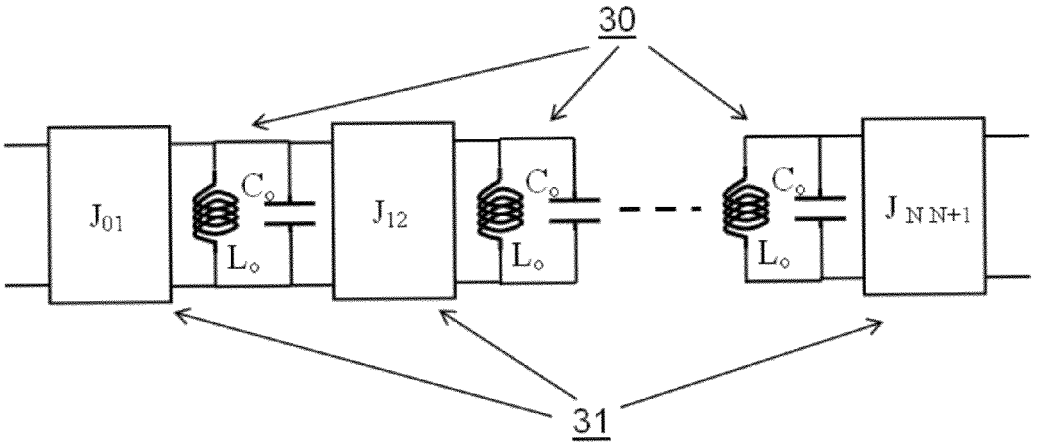
Prior art Fig. 2
FIG. 2 represents a filter synthesis model of the resonant cavity of FIG. 1 employing admittance inverters.
Figure 3:
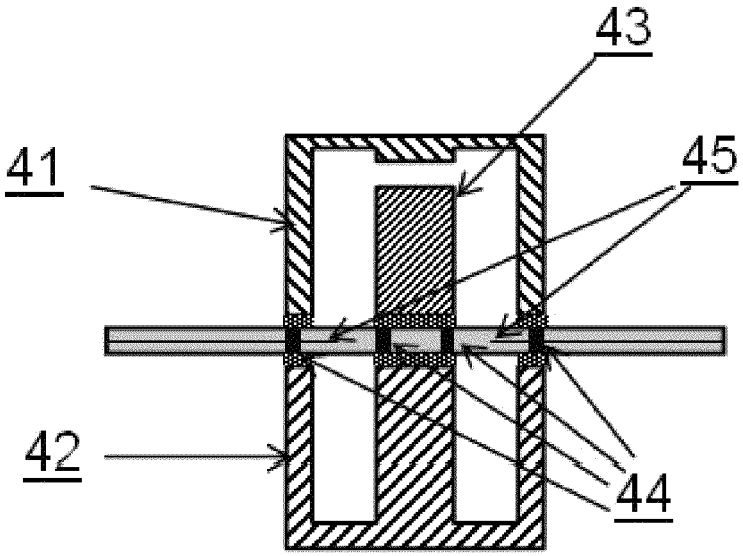
Prior art Fig. 3
FIG. 3 shows another PCB-mounted resonant cavity as known from prior art.

In a conventional filter configuration, electromagnetic signals have to be guided to and from each of the resonators that comprises the filter, as shown in FIG. 1. Therefore, two coupling mechanisms, similar with those presented in the previous text, are required to be implemented within each of the cavities. This is depicted in FIG. 7, where an input transmission line 81 guides the signal to an input metalized feeding pad in the cavity through the coupling mechanism 82, while the coupling mechanism 83 couples the signal from an output metalized feeding pad in the cavity to an output transmission line 84.

Figure 7:
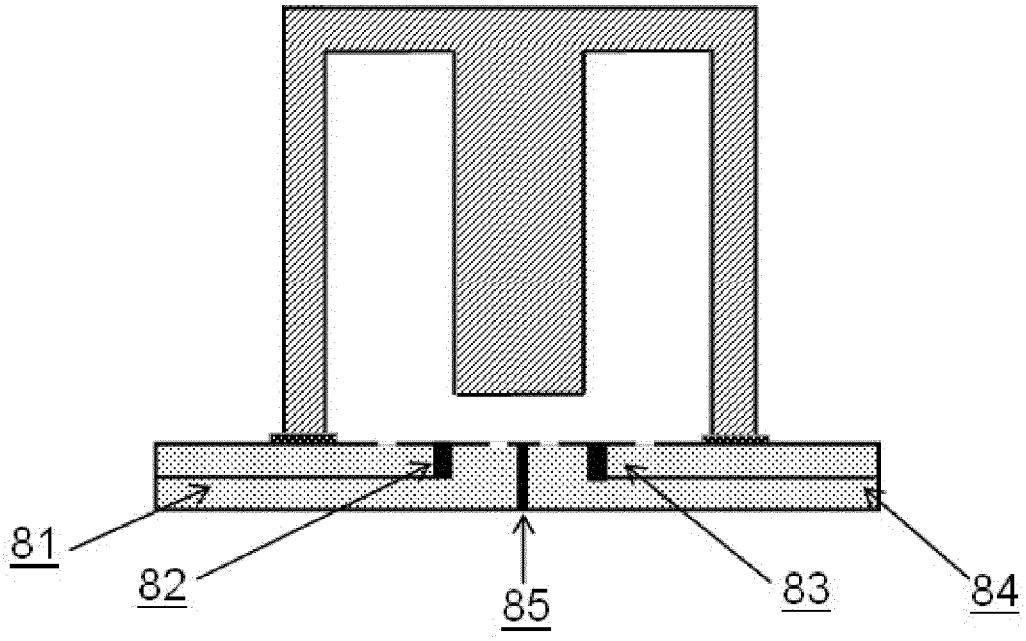
FIG. 7 shows a coupling mechanism employed to couple signals from a PCB-embedded waveguide (stripline) to a single resonant cavity and reverse according to another embodiment of the invention.

The configuration of FIG. 7 is prone to several parasitic phenomena that may influence, deteriorate or limit the operation of the cavity resonator as part of a microwave filter. Given its compact size, the coupling mechanisms 82 and 83 are located close to each other.

This may result in some direct coupling between them, either through the resonant cavity itself or through the substrate on which the cavity is mounted, deteriorating the electromagnetic performance of the resonator.

Even though the latter case can be addressed with the use of an electric wall 85 inserted between them (this wall can be implemented using closely spaced coppers vias), there is very little to be done to avoid direct electromagnetic coupling between the two coupling mechanism through the resonant cavity. In fact, a simple solution to this problem would be to keep them as far as possible from each other.

Nevertheless, this approach would reduce the overlapping area between each of the coupling disks and the inner stub of the resonator (75 in FIG. 5) and therefore the total achievable coupling coefficient implemented by each of those mechanisms. Therefore, a configuration similar with that of FIG. 7 may not be the preferred implementation of filters composed of cavity resonators mounted on a PCB.

Figure 8:
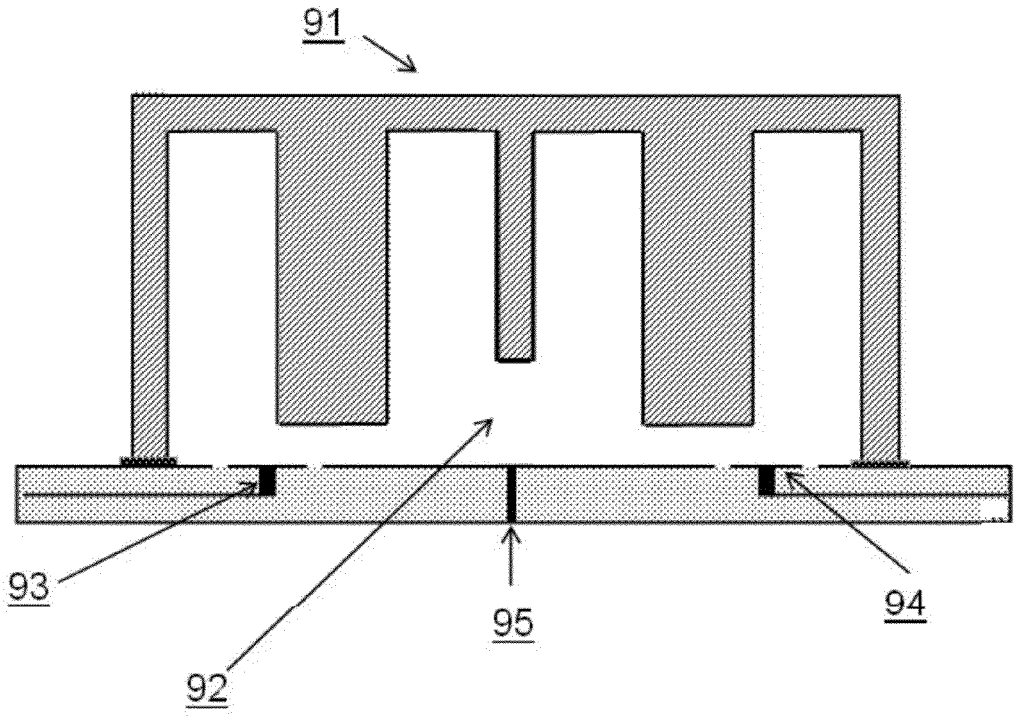
FIG. 8 shows a coupling mechanism employed to couple signals from a PCB-embedded waveguide (stripline) to a pair of inductively coupled resonant cavities and reverse according to another embodiment of the invention.

A preferred alternative implementation of such filters is shown in FIG. 8. In the context of this implementation, the modular elements for the design of PCB-mounted resonant cavity filters are considered to be pairs of inductively coupled 3-D resonant coaxial cavities, similar with that shown in FIG. 8. In this approach, any two of the 3-D coaxial resonators have to be built within one block 91. On the common electric wall 95 separating the input resonant cavity from the output resonant cavity, an iris open window 92 secures the inductive coupling between the two cavities built on the same block. The input/output resonant cavity of the pair is provided with a distinct input/output inner stub orthogonal to the PCB and separated thereof by an input/output capacitive gap, respectively. Moreover, an input metalized feeding pad is implemented in the input resonant cavity of the pair, whilst an output metalized feeding pad is implemented in the output resonant cavity of the pair. The input metalized feeding pad is facing the end face of the input inner stub in the area of the input capacitive gap and is offset from the axial direction of this input inner stub, whilst the output metalized feeding pad is facing the end face of the output inner stub in the area of the output capacitive gap and is offset from the axial direction of this output inner stub.

The exact dimensions of the coupling window 92 determine the magnitude of the corresponding inductive coupling.

The advantage of a configuration similar with that of FIG. 8 is that it allows to feed the microwave signal from the PCB to the input cavity through the input coupling mechanism 93 and then couple out the filtered signal from the output cavity to the PCB through the output coupling mechanism 94.

In that way, the two PCB-cavity coupling mechanisms are implemented in two different cavities and therefore no significant parasitic direct coupling between them (through the cavities) is present.

Furthermore, the design parameters associated with each of the two coupling mechanisms (i.e. feeding disk diameter, position of the feeding disk etc) are free to be chosen according to the requirements of the filter design procedure without having to satisfy any major restrictions (i.e. size, relative position of the two coupling mechanisms etc).

Figure 9:
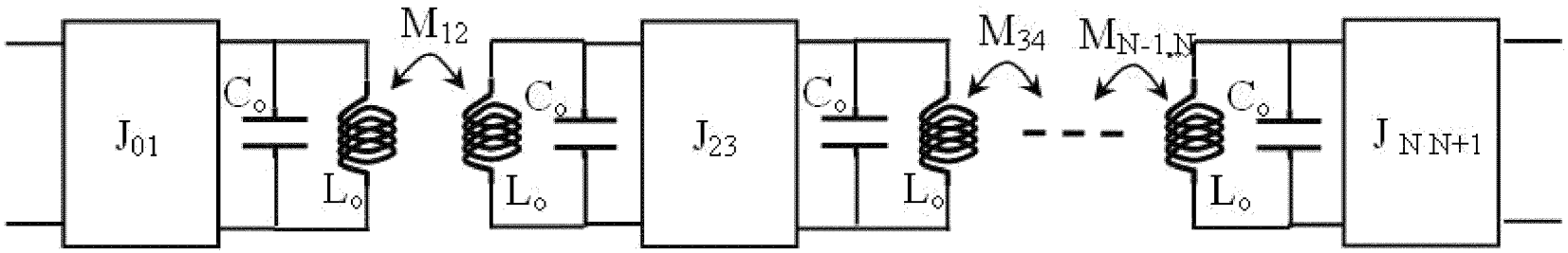
FIG. 9 represents a filter synthesis model according to the configuration of FIG. 8.

When the configuration of FIG. 8 is employed for the synthesis of filtering devices, the filter functions should be synthesized according to the model of FIG. 9. In this model, the input and output coupling to and from the first and last resonator of the filter is implemented through transmission line based admittance inverters ($J_{01}$ and $J_{NN+1}$), while the coupling between the resonators are implemented interchangeably using inductive coupling irises ($M_{ij}$) and transmission line based impedance inverters ($J_{ij}$).

In order to verify the possibility of designing PCB-mounted filters employing 3-D re-entrant (coaxial) resonators excited and interconnected by means of the coupling mechanisms proposed in this invention, a $4^{th}$-order Chebyshev filter has been designed and simulated. The targeted operating band for this filter has been the downlink Tx band of the WCDMA air interface (2110 MHz-2170 MHz).

Figure 10:
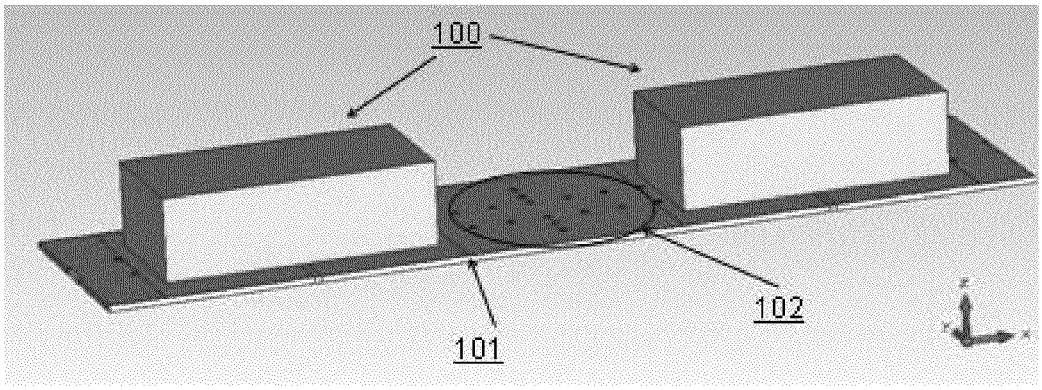
FIG. 10 shows a 3-D model of a 4-pole Chebyshev filter that employs a coupling mechanism according to an embodiment of the present invention to couple the microwave signal from a PCB-embedded waveguide (stripline) to the 3-D resonant cavities and reverse.

The model employed for the simulation of this filter is depicted in FIG. 10. For this filter implementation, the configuration of FIG. 8 was employed. Specifically, the four resonators of the $4^{th}$ order filter were built in two pairs of inductively coupled resonators. Then these two pairs were interconnected through admittance inverters implemented on the PCB and the filter function was synthesized according to the model of FIG. 9.

Referring to the 3-D model of FIG. 10, the two pairs of inductively coupled cavities are milled in two metallic volumes 100. These volumes are considered to be soldered on the top surface of a PCB 101 that is metal-plated on both its upper and lower sides. Inside the PCB, striplines are employed to synthesize the interconnecting admittance inverters. Furthermore, copper vias 102 have been embedded within the PCB, shorting the two sides of the PCB (ground planes of the employed striplines), to enhance electromagnetic isolation between the coupling mechanisms and reduce the parasitic effects associated with the operation of the striplines.

Figure 11:
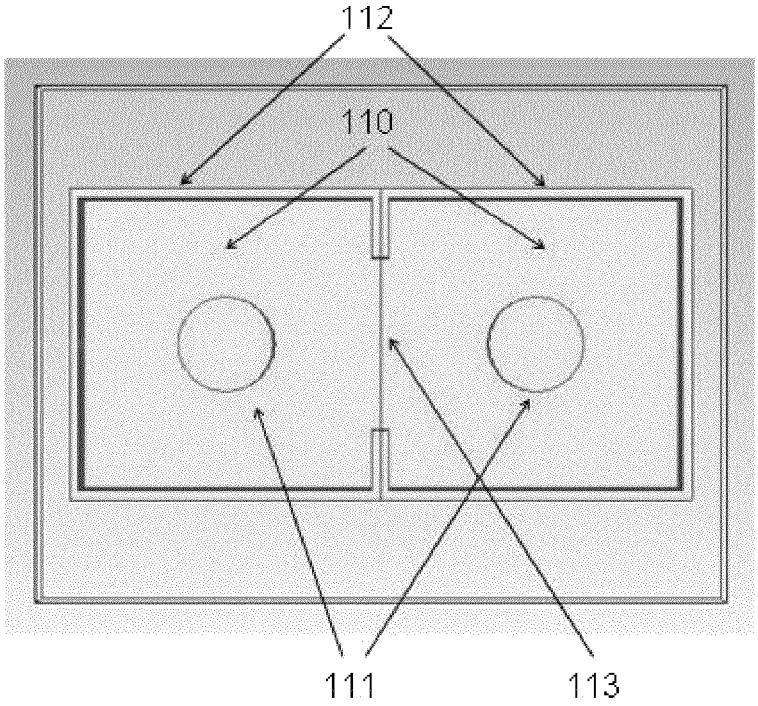
FIG. 11 is a bottom-view of a single pair of inductively coupled resonant cavities employed in the 3-D model of FIG. 10.

The bottom view of each of the two inductively coupled pairs of the re-entrant resonators milled in metallic volumes (100 in FIG. 10) is depicted in FIG. 11. In this implementation, the two resonant cavities 110 are composed of cylindrical inner rods 111 and rectangular outer walls 112. In the general case, the shapes of the inner and outer contactors can be any that support a similar coaxial configuration. Finally, the two cavities are coupled through an iris 113 that is formed by removing material from the walls separating the two cavities.

Figure 12:
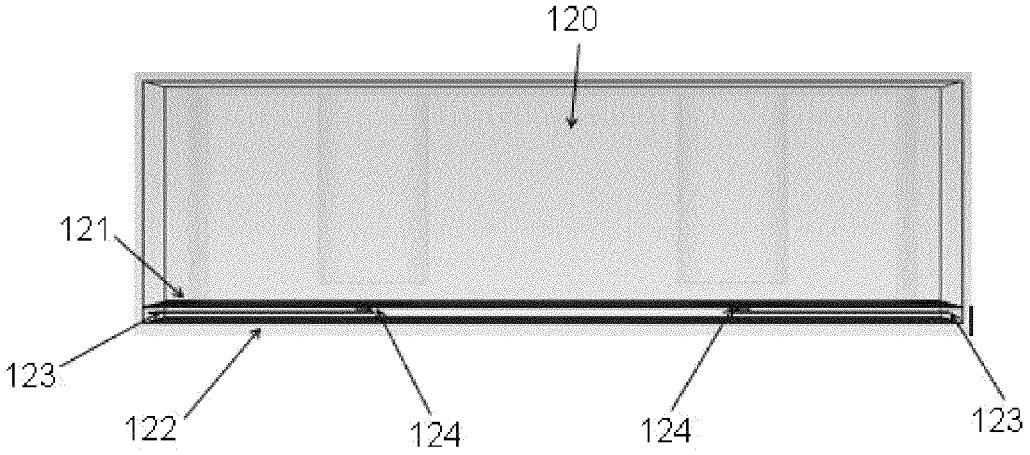
FIG. 12 is a cross-section view of the 3-D model of FIG. 10 along a single pair of inductively coupled resonant cavities.

In FIG. 12, the cross-section of the 3-D filter model along one pair of inductively coupled cavities is depicted. As shown, the signal is guided to and from the pair of cavities through the striplines 123 that have been embedded in the PCB that bares the cavities. The aforementioned striplines use metallic surfaces 121 and 122 as upper and lower ground planes, while the surface 121 is also used to attach on the 3-D parts of the resonant cavities. These striplines are connected with the feed disks of the upper ground plane layer 121 of the PCB using copper vias 124.

Figure 13:
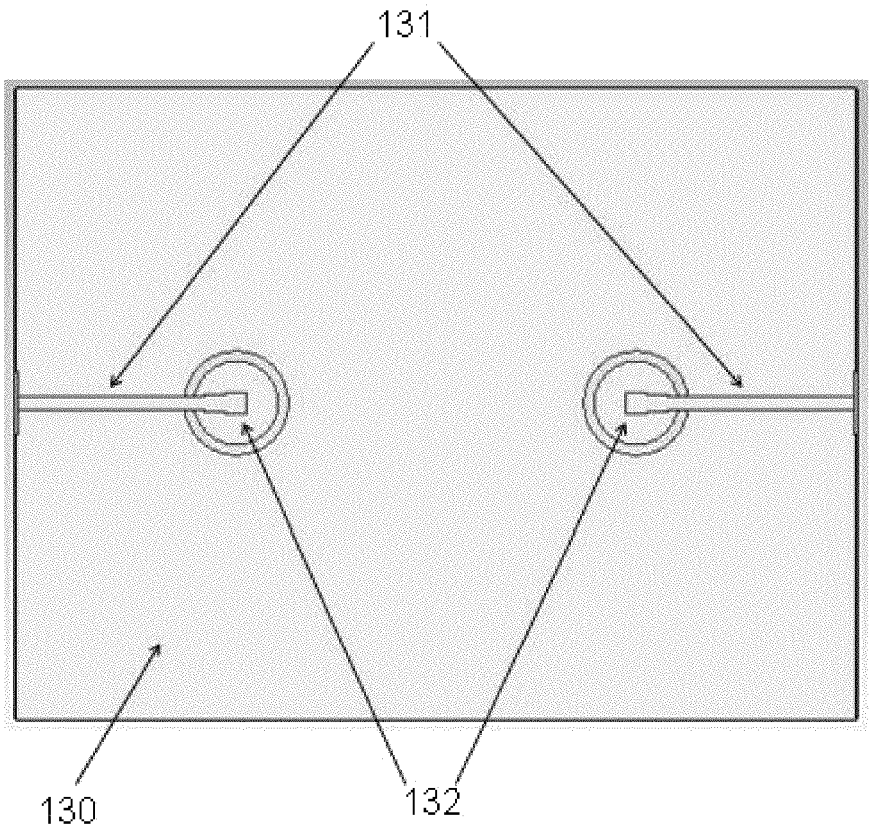
FIG. 13 shows a coupling mechanism of the microwave signal from the PCB-embedded striplines (131) to the inductively coupled pair of resonant cavities.

A better representation of the mechanisms that couple the signals from the striplines to the resonant cavities through the vias and the feeding disks is shown in FIG. 13. Specifically, in FIG. 13, input/output striplines 131 feed the RF signal to coupling disks 132 that have been formed on a metallic surface 130 that, apart from operating as an upper ground plane for the stripline, also is used to attach the 3-D resonant cavity.

Figure 14:
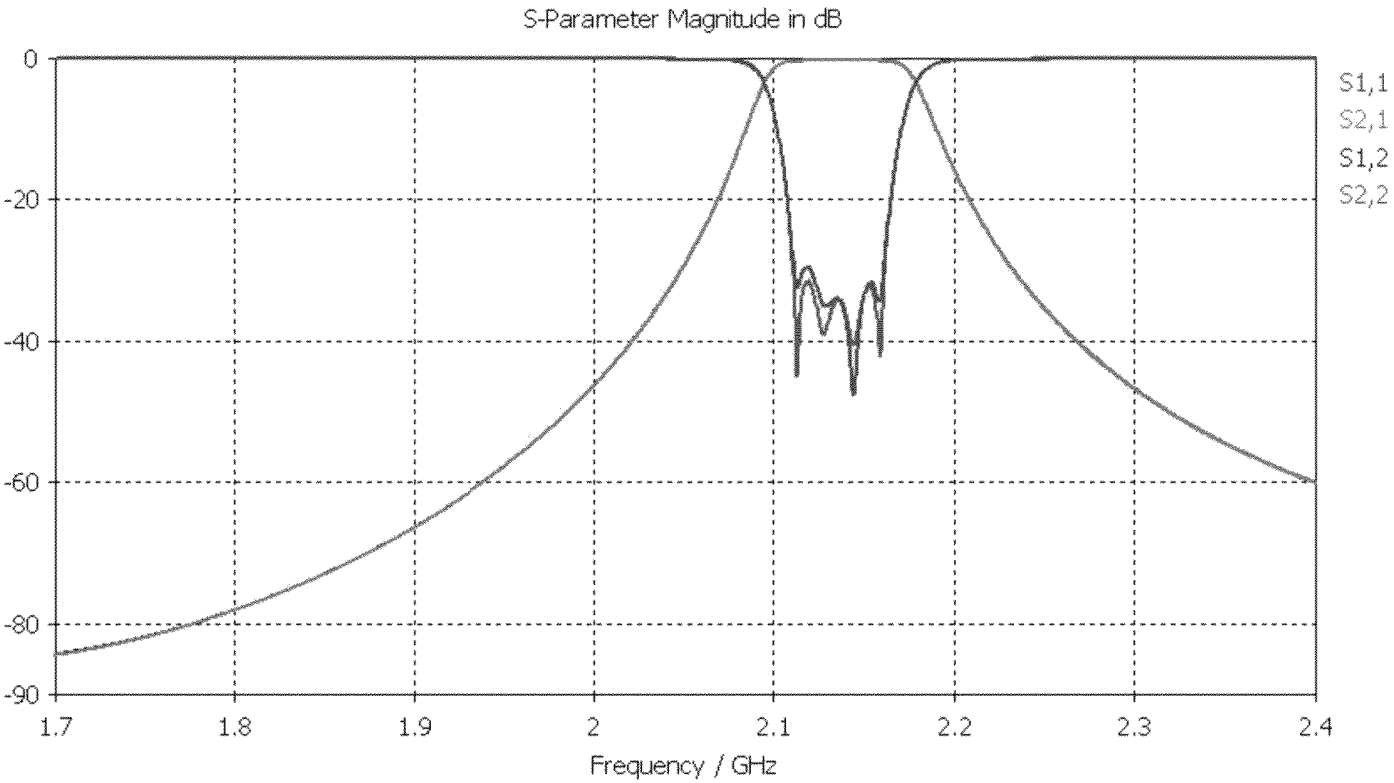
FIG. 14 represents a simulated response of the 4-pole filter of FIG. 10.

Finally, the full-wave simulated response of the 4-pole Chebyshev filter of FIG. 10 is depicted in FIG. 14, which represents the S-parameters in dB (vertical axis) of the aforementioned filter structure against the frequency bands in GHz of interest (horizontal axis). According to these results, low insertion loss is achieved across the passband of the filter (<0.6 dB) while a better than 50 dB isolation for the downlink Rx band of the WCDMA air interface is also achieved.

It is to be noted that the present coupling mechanism can be used to couple signals not only to/from single or double cavities but in a more general case to structures composed of an arbitrary large number of cavities. To this end, the general coupling mechanism comprises several resonant cavities mounted on the PCB, which is provided with a same amount of embedded transmission lines each having an end provided with a metalized feeding pad located inside a distinct one of the resonant cavities. Each resonant cavity is provided with an inner stub orthogonal to the PCB and separated thereof by a capacitive gap. Each metalized feeding pad is facing the end face of a corresponding inner stub in the area of the capacitive gap and is offset from the axial direction of the corresponding inner stub. The metalized feeding pads are further separated by electric walls.

A final remark is that embodiments of the present invention are described above in terms of functional blocks. From the functional description of these blocks, given above, it will be apparent for a person skilled in the art of designing electronic devices how embodiments of these blocks can be manufactured with well-known electronic components. A detailed architecture of the contents of the functional blocks hence is not given.

While the principles of the invention have been described above in connection with specific apparatus, it is to be clearly understood that this description is merely made by way of example and not as a limitation on the scope of the invention, as defined in the appended claims.

The invention claimed is:

1. An apparatus, comprising:

a printed circuit board PCB having a first surface;

a resonant cavity mounted on the first surface, the resonant cavity including a first stub orthogonal to the first surface and separated from the first surface by a first gap;

a first transmission line embedded in the PCB;

a first metalized feeding pad electrically connected to the first transmission line, the first metalized feeding pad at the first surface, a distance between the first metalized feeding pad and the first stub being substantially equal to the first gap, at least a portion of the first metalized feeding pad overlapping with at least a first portion of the first stub in an axial direction of the first stub.

2. The apparatus of claim 1, wherein the PCB includes a metal layer forming the first surface, the first metalized feeding pad is substantially co-planer with the metal layer, and the first metalized feeding pad is separated from the metal layer by a second gap.

3. The apparatus of claim 2, wherein the first metalized feeding pad has a disk shape and the second gap has an annular shape.

4. The apparatus of claim 3, wherein a center of the first metalized feeding pad is offset from a longitudinal axis of the first stub.

5. The apparatus of claim 1, wherein the transmission line is a waveguide implemented in microstrip or stripline technology.

6. The apparatus of claim 1, further comprising:

a second transmission line embedded in the PCB;

a second metalized feeding pad electrically connected to the second transmission line, the second metalized feeding pad at the first surface, the second metalized feeding pad separated from the first stub by the first gap, at least a portion of the second metalized feeding pad overlapping with at least a second portion of the first stub in the axial direction of the first stub; and an electrical wall embedded in the PCB to separate the first and second transmission lines.

7. The apparatus of claim 6, wherein the electric wall includes closely spaced copper vias in the PCB.

8. The apparatus of claim 1, wherein the resonant cavity is constituted by first and second inductively coupled sub resonant cavities built within a same block, the first sub resonant cavity includes the first stub, and the second sub resonant cavity includes a second stub, and an iris open window is provided between the first and second sub resonant cavities;

the apparatus further including, a second transmission line embedded in the PCB;

a second metalized feeding pad electrically connected to the second transmission line, the second metalized feeding pad at the first surface, the second metalized feeding pad separated from the second stub by the first gap, at least a portion of the second metalized feeding pad overlapping with at least a second portion of the second stub in an axial direction of the second stub; and a common electrical wall separating the first and second resonant cavities.

9. An apparatus, comprising:

a printed circuit board PCB having a first surface;

a plurality of resonant cavities mounted on the first surface, each of the plurality of resonator cavities including a stub orthogonal to the first surface, each of the stubs separated from the first surface by a first gap;

a plurality of transmission lines embedded in the PCB;

a plurality of metalized feeding pads electrically connected to respective ones of the plurality of transmission lines, the plurality of metalized feeding pads at the first surface, a distance between each of the plurality of metalized feeding pads and a respective one of the stubs being substantially equal to the first gap, at least a portion of each of the plurality of metalized feeding pads overlapping with at least a portion of the respective one of the stubs in an axial direction of the respective stub.

* * * * *